US006340214B1

(12) United States Patent
Adams

(10) Patent No.: US 6,340,214 B1
(45) Date of Patent: Jan. 22, 2002

(54) SAFETY SHELF

(76) Inventor: H. Lee Adams, 6701 N. Country Rd. 1200 E, Charleston, IL (US) 61920

( * ) Notice: Subject to any disclaimer, the term of this patent is extended or adjusted under 35 U.S.C. 154(b) by 0 days.

(21) Appl. No.: 09/630,085

(22) Filed: Aug. 1, 2000

(51) Int. Cl.[7] ..... A47F 5/08
(52) U.S. Cl. ..... 312/246; 312/325; 211/1.3
(58) Field of Search ..... 312/246, 247, 312/248, 270.2, 325; 211/1.3, 104, 150; 248/284.1, 291.1; 108/1, 4, 6, 9

(56) References Cited

U.S. PATENT DOCUMENTS

| | | | | | |
|---|---|---|---|---|---|
| 589,318 | A | | 8/1897 | Tabb | |
| 876,159 | A | | 1/1908 | Erickson | |
| 1,247,367 | A | * | 11/1917 | Burchell | 312/325 X |
| 2,258,838 | A | | 10/1941 | Aldeen | |
| 2,322,648 | A | | 6/1943 | Lundstrom | |
| 2,598,266 | A | * | 5/1952 | Kamin et al. | 312/325 X |
| 2,643,167 | A | * | 6/1953 | Wade | 312/246 X |
| 2,822,229 | A | | 8/1958 | Carlson | |
| 3,401,992 | A | * | 9/1968 | Benson et al. | 312/325 X |
| 4,134,629 | A | | 1/1979 | Hansen et al. | |
| 4,915,461 | A | * | 4/1990 | Kingsborough et al. | 312/248 X |
| 5,058,846 | A | | 10/1991 | Close | |
| 5,308,158 | A | | 5/1994 | Vogelgesang et al. | |
| 5,462,347 | A | | 10/1995 | Vogelgesang et al. | |
| 5,556,179 | A | | 9/1996 | Weidner | |

FOREIGN PATENT DOCUMENTS

| | | | | |
|---|---|---|---|---|
| NL | 7412394 | * | 6/1975 | 312/325 |

* cited by examiner

*Primary Examiner*—Peter R. Brown
*Assistant Examiner*—James O. Hansen
(74) *Attorney, Agent, or Firm*—Howard A. Kenyon

(57) ABSTRACT

A pull down storage shelf assembly for a standard wall cabinet to access items on the upper storage shelf is described. The shelf assembly has two arms on each side attached to an upper support member on one end and a lower support member on the other end. The position of the two side arms with respect to the upper and lower support member allows the shelf to hold in place when in the up position. A handle is secured to the front and bottom of the pull down shelf. When the handle is pulled forward, the upper shelf rotates to the down position to provide easy access to items on the upper shelf. A stop is placed on the side of the upper support members to stop the downward motion and support the shelf at the optimum working level.

13 Claims, 2 Drawing Sheets

SAFETY SHELF

BACKGROUND OF THE INVENTION

1. Field of the Invention

This invention relates to a shelf assembly in general and more specifically one that can be pulled down to obtain access to items on the shelf.

2. Description of the Prior Art

There have been numerous attempts made to gain access to contents of a shelf that is out of reach of a person. Some of the related patents are:

U.S. Pat. No. 589,318 to Tabb describes a removable shelf in case of fire, flood or other emergencies.

U.S. Pat. No. 2,258,838 to Aldeen describes a chest that has a tray that moves up when the chest is open. Today's jewelry chest has this type of tray.

U.S. Pat. No. 5,308,158 to Vogelgesang et al describes a pull down shelf assembly that is spring biased which assists in returning the shelf to the up position.

U.S. Pat. No. 5,462,347 to Vogelgesang describes a pull down shelf assembly using a different spring biased from U.S. Pat. No. 5,308,158 which also assists in returning a shelf to the up position.

U.S. Pat. No. 876,159 to Erickson describes a drawer that can be pulled out sideways to obtain access to contents in the drawer.

U.S. Pat. No. 2,822,229 to Carlson describes a section of a desk top that can rotate downward and is spring biased.

U.S. Pat. No. 5,556,179 to Weidner describes a spring biased retractable suspension shelf.

U.S. Pat. No. 2,322,648 to Lundstrom describes a disappearing support for business machines and the like.

U.S. Pat. No. 5,058,846 to Close describes a pull down display and storage apparatus for cabinets in a commercial store.

U.S. Pat. No. 4,134,629 to Hansen describes a combination pivotable shelving having an associated pivotable door.

None of the above patents provide a simple pull down storage shelf assembly that is free from springs or complex linkage assembly as in the present invention and also requiring numerous parts which are very difficult to use and assemble. What is needed is a simple, low cost mechanism that can be attached to a cabinet by a lay person without having to resort to an experienced cabinet maker.

SUMMARY OF THE INVENTION

It is the object of the present invention to provide a pull down shelf assembly.

It is another object of the present invention to use a pull down shelf assembly in a standard wall cabinet by cutting off the ends and using the existing shelf.

It is yet another object of the present invention to maintain the upper storage shelf member in a level position through its travel from the up position to the down position.

It is still another object of the present invention to provide access to items on the upper shelf member when the pull down shelf assembly is in a down position.

Briefly, in accordance with the present invention, there is provided a pull down shelf assembly that provides access to items on a shelf that was otherwise inaccessible when the shelf is in the up position. The pull down shelf assembly in the present invention is designed for a standard wall cabinet that has fixed dimension and is further described in this application.

Other objects and advantages will become apparent from the following description and appended claims taken in conjunction with the accompanying drawings.

DESCRIPTION OF THE DRAWINGS

In the drawings, which illustrate the best mode presently contemplated for carrying out the present invention.

The novel features which are believed to be characteristics of the invention, both as its organization and its method of operation, together with further objects and advantages thereof, will be better understood from the following description in connection with the accompanying drawings in which a presently preferred embodiment of the invention is illustrated by way of example. It is to be expressly understood, however, that the drawings are for purposes of illustration and description only and are not intended as a definition of the limits of the invention.

DESCRIPTION OF THE PREFERRED EMBODIMENT

The pull down storage shelf assembly is directed to a standard wall cabinet. By definition, a standard wall cabinet is 12 inches deep measured on the outside. The distance between the upper surface of an upper shelf and the top surface of a lower shelf is 9 inches. The shelf for a standard wall cabinet is 11 inches deep and the shelf thickness of ¾ inches. The present invention is designed for a standard wall cabinet. Standard wall cabinets are prefabricated by large cabinet manufacturers and are sold in large retail home improvement centers. Standard wall cabinets provide 90 percent of the retail cabinet market.

Figure 1:
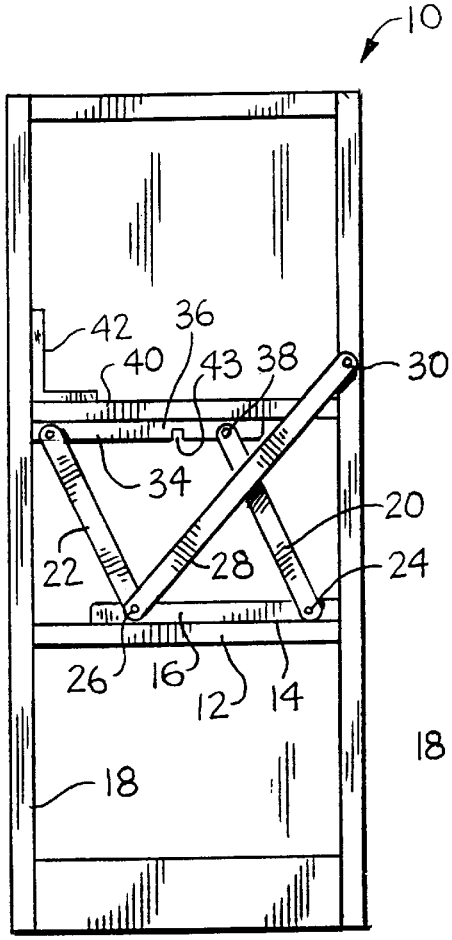
FIG. 1 is a left side exposed view of a standard wall cabinet showing the pull down shelf assembly in an up position, the right side being a mirror image.

Turning now to FIG. 1 there is seen an exposed side view of a pull down shelf assembly generally shown as 10. The lower shelf 12 has attached thereto on the top of the lower shelf 12, a tee section 14, called a lower support member, the tee section having a web 16. The lower shelf 12 is fastened to the sides and rear 18 of the cabinet by common fastening means such as glue, screws and nails. Rotatably attached to web 16 are the lower ends of rigid swing members 20 and 22. Rigid swing members 20 and 22 are attached to the web 16 by pins 24 and 26. Rigid swing members 20 and 22 are parallel to each other. Also seen in this view is a brace member 28 attached at one end by pin 26 and attached at the other end by fixed means such as a screw 30 fastened to the frame of the standard wall cabinet. Also seen in this view is upper storage shelf 32 having a tee section 34 called an upper support member attached to the bottom of upper storage shelf 32. Upper storage shelf 32 is not attached to the back wall 18 or the side walls (not shown) of the standard cabinet 10. Tee section 32 has a web 36 which has rotatably attached thereto the upper ends of rigid swing members 20 and 22. The upper ends of rigid swing members 20 and 22 are attached to web 36 by rivets 38 and 40. Also seen in this view is a section of retainer member 42. The retainer member 42 is fitted to the back of upper storage shelf 32 to keep items from falling off as the upper storage shelf 32 travels from the upper to the lower position. Also seen in this view is stop 43 which stops the upper storage shelf 32 when the upper storage shelf 32 reaches the down position.

Figure 2:
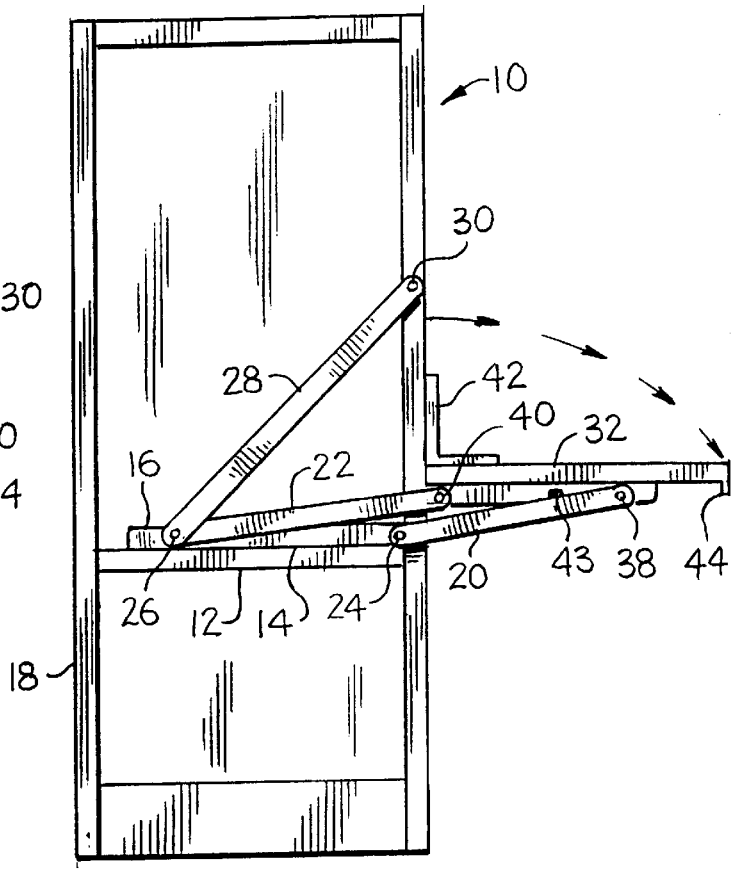
FIG. 2 is a left side exposed view of a standard wall cabinet showing the pull down shelf in a down position, the right side being a mirror image.

Turning now to FIG. 2 there is seen the upper storage shelf 32 in a down position. Rigid swing members 20 and 22 have rotated about rivets 24 and 26 and 38 and 40 which allowed the upper storage shelf 32 to swing down and out to the position in FIG. 2. The stop 43 engages rigid swing members 20 and 22 and prevents the upper storage shelf 32 from further down travel. Brace 28 is fastened to the frame of the standard wall cabinet by fixed means such as a screw 30. A handle to pull the shelf to a down position or to push the shelf to an up position is shown as 44.

Figure 3:
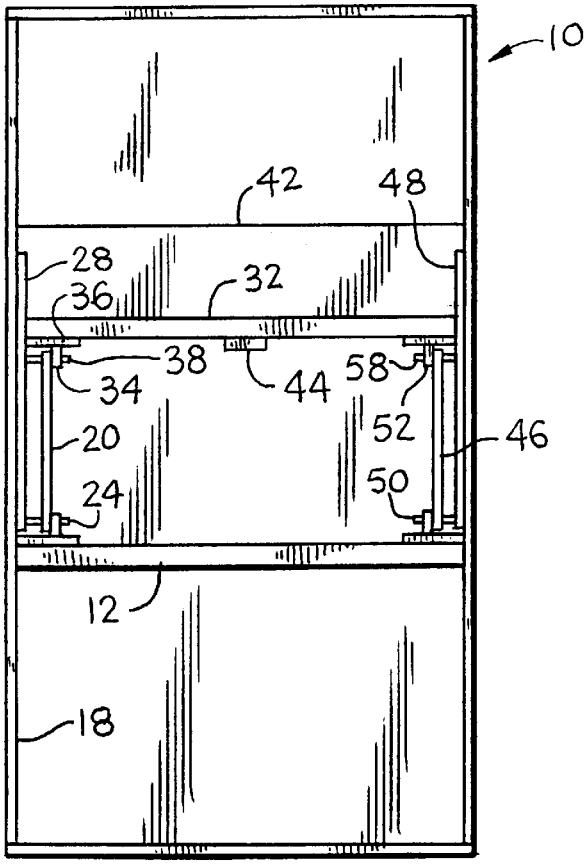
FIG. 3 is a front view of a standard wall cabinet showing the pull down shelf in a up position.

FIG. 3 provides a front view of a standard wall cabinet with the upper storage shelf 32 in the up position. In this view the right side of the upper storage shelf 32 can also be seen. Rigid swing members 20 and 46 can be seen in this view. Also, brace members 28 and 48 can be seen in the view. Also seen is handle 44 attached to the upper storage shelf 32. The back portion of the retaining member 42 is also seen. Web members 36 and 52 which are attached to the bottom of upper storage shelf 32 are shown in this view. The pins 24 and 38 about which rigid swing member 20 rotates is seen along with pins 50 and 52 about which rigid swing member 46 rotates.

Figure 4:
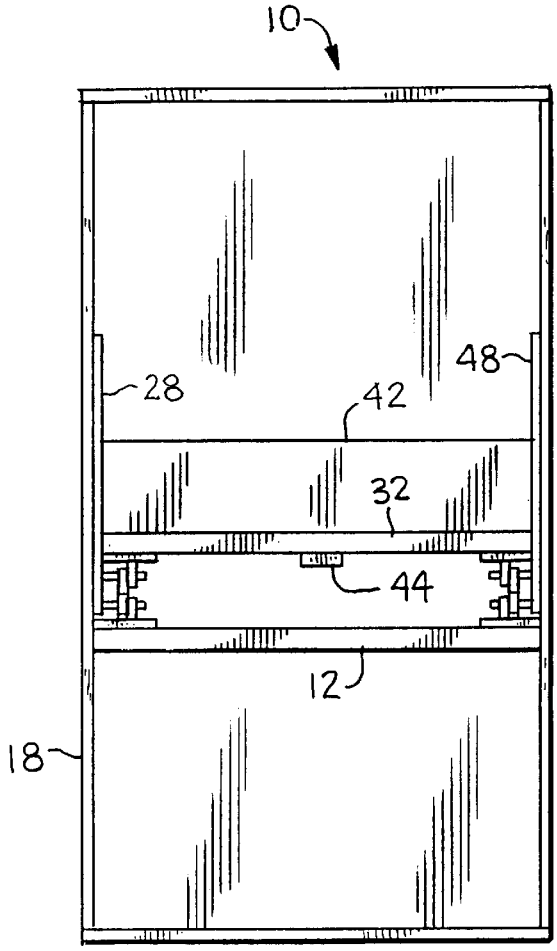
FIG. 4 is a front view of a standard wall cabinet showing the pull down shelf in a down position.

FIG. 4 shows a front view of a standard wall cabinet with the pull down upper storage shelf 32 in the down position. Lower shelf 12 can also be seen in this view along with brace members 28 and 38. Handle 44 is seen attached to the upper storage shelf 32.

Thus, it is apparent that there has been provided, in accordance with the invention, a storage shelf assembly that fully satisfies the objectives, aims, and advantages as set forth above. While the invention has been described in conjunction with specific embodiments thereof, it is evident that many altematives, modifications, and variations will be apparent to those skilled in the art in light of the foregoing description. Accordingly, it is intended to embrace all such altematives, modifications, and variations that fall within the spirit and scope of the appended claims.

What is claimed is:

1. A pull down shelf assembly, in combination with a standard wall cabinet, for fitting inside said standard wall cabinet comprising:

an upper storage shelf having a top, a bottom, a front end and a back end and two side ends, said upper storage shelf having a handle on said front end;

an upper support member attached to said bottom on each side of said upper storage shelf, said upper support member having a web member perpendicular to said bottom of said upper storage shelf;

a lower storage shelf directly below said upper storage shelf, said lower storage shelf having a top, a bottom, a front end, a back end and two side ends, said lower shelf being attached to said cabinet;

a lower support member attached to said top and on each of said two side ends of said lower storage shelf, said lower support member having a web perpendicular to said top of said lower shelf;

a first rigid swing member and a second rigid swing member having upper and lower ends, said upper ends rotatably attached to said web on said upper support member by rivets secured to said web and said lower ends rotatably attached to said web on said lower support member by pins secured to said web;

said first and said second rigid swing members being parallel to each other.

2. A pull down shelf assembly as described in claim 1 wherein said two rigid swing members are of the same length.

3. A pull down shelf assembly as described in claim 1 wherein the standard distance between the top surface of said upper storage shelf member and the top surface of said lower storage shelf member is 9 inches for a standard 12 inch deep wall cabinet wherein said upper storage shelf member and said lower storage shelf member is 11 inches deep arid the thickness of said shelf members is ¾ inches.

4. A pull down shelf assembly as described in claim 1 wherein said first rigid swing member lower end is attached to said lower support member.

5. A pull down shelf assembly as described in claim 1 wherein said second swing member upper end is attached to said upper support member.

6. A pull down shelf assembly as described in claim 1 wherein a pull force on said upper storage shelf member by said handle attached to said front end of said upper storage shelf allows said upper storage shelf to go from an up position to a down position.

7. A pull down shelf assembly as described in claim 1 wherein a push force on said upper storage shelf by said handle attached to said front end of said upper storage shelf allows said upper storage shelf to go from a down position to a up position.

8. A pull down shelf assembly as described in claim 7 wherein said up position is in a fixed position due to the length of the rigid swing members used in a standard cabinet.

9. A pull down shelf assembly as described in claim 1 wherein said top of said upper storage shelf has a retaining member attached to the back and two ends of said upper storage shelf.

10. A pull down shelf assembly as described in claim 1 wherein a stop is attached to said webs of said upper support members to stop said upper storage shelf in the down position.

11. A pull down shelf assembly as described in claim 1 wherein said upper storage shelf remains level at all times during the transition from an up position to a down position.

12. A pull down shelf assembly as described in claim 1 wherein said pull down shelf assembly has brace members with one end fastened to where said rigid swing members lower ends are fastened to said web members and the other end is fastened to a cabinet frame.

13. A pull down shelf assembly as described in claim 1 wherein the down position of the upper storage shelf member allows access to the items on the upper storage shelf.

* * * * *